US009961966B2

(12) United States Patent
Ryan

(10) Patent No.: US 9,961,966 B2
(45) Date of Patent: May 8, 2018

(54) SYSTEM AND METHOD FOR A DETACHABLE BUTTON

(71) Applicant: Timothy J. Ryan, Chicago, IL (US)

(72) Inventor: Timothy J. Ryan, Chicago, IL (US)

( * ) Notice: Subject to any disclaimer, the term of this patent is extended or adjusted under 35 U.S.C. 154(b) by 0 days. days.

(21) Appl. No.: 15/822,886

(22) Filed: Nov. 27, 2017

(65) Prior Publication Data

US 2018/0070681 A1 Mar. 15, 2018

Related U.S. Application Data

(63) Continuation-in-part of application No. 14/540,850, filed on Nov. 13, 2014.

(60) Provisional application No. 61/904,136, filed on Nov. 14, 2013.

(51) Int. Cl.

| | |
|---|---|
| ***A44B 1/00*** | (2006.01) |
| ***A44B 1/14*** | (2006.01) |
| ***A44B 1/20*** | (2006.01) |
| *A44B 1/04* | (2006.01) |

(52) U.S. Cl.

CPC ..... *A44B 1/14* (2013.01); *A44B 1/20* (2013.01); *A44B 1/04* (2013.01)

(58) Field of Classification Search

CPC ..... A44B 1/20; A44B 1/14; A44B 99/005; A44B 17/0064; Y10T 24/3653; Y10T 24/4578; Y10T 24/3662

See application file for complete search history.

(56) References Cited

U.S. PATENT DOCUMENTS

| | | | | | |
|---|---|---|---|---|---|
| 478,174 | A | * | 7/1892 | Sherer | A44B 1/32 24/109 |
| 480,352 | A | * | 8/1892 | Turner | A44B 1/32 24/109 |
| 625,532 | A | * | 5/1899 | Bachman | A44B 1/30 24/105 |
| 1,511,445 | A | * | 10/1924 | Clarkson | A44B 1/30 24/105 |
| 1,626,582 | A | * | 4/1927 | Kaynor | A44B 1/14 24/113 MP |
| 1,691,064 | A | * | 11/1928 | Hoppe | A43C 11/24 2/245 |
| 1,714,230 | A | * | 5/1929 | Miles | A44B 1/14 24/694 |
| 2,075,722 | A | * | 3/1937 | Illsche | A44B 1/30 24/105 |
| 2,175,840 | A | * | 10/1939 | Isasi | A44B 1/28 24/102 E |

(Continued)

*Primary Examiner* — Jason W San

(74) *Attorney, Agent, or Firm* — Patti & Malvone Law Group, LLC

(57) ABSTRACT

A detachable button system has a fixed component permanently attached to a garment and a detachable button component. The fixed component a disc-shaped base and a cylinder extending perpendicularly from said base, said cylinder featuring a plurality of tabs projecting perpendicularly from the cylinder and parallel to the base. The detachable portion had an interior cavity for receiving the cylinder, the interior cavity including a plurality of slots corresponding to the plurality of tabs, the slots receiving said tabs. The tabs vary across their width so as to provide a friction fit when the cylinder of the fixed component is inserted into the internal cavity of the detachable component and the detachable component is rotated.

7 Claims, 12 Drawing Sheets

(56) References Cited

U.S. PATENT DOCUMENTS 2,579,124 A * 12/1951 Patterson ..... A44B 1/28 24/105
2,944,311 A * 7/1960 Schneckenberger ..... A44B 1/28 24/104
3,098,375 A * 7/1963 Friedler ..... D06F 95/008 15/257.01
3,135,032 A * 6/1964 Althens ..... A44B 1/28 24/101 R
3,186,050 A * 6/1965 Moise ..... A44B 1/30 24/105
3,583,039 A * 6/1971 Walker ..... A44B 1/04 24/105
3,643,296 A * 2/1972 Kahn ..... A44B 1/28 24/108
3,644,965 A * 2/1972 Kahn ..... A44B 1/28 24/108
4,486,918 A * 12/1984 Peebles ..... G05G 1/10 16/422
5,093,965 A * 3/1992 Mauras ..... A44B 1/08 24/113 MP
6,102,761 A * 8/2000 Fleming ..... B63B 35/7933 24/105
7,748,089 B2 * 7/2010 Jalbert ..... F16B 5/0657 24/297
7,788,772 B2 * 9/2010 Dandurand ..... A41F 15/02 24/105
8,061,923 B2 * 11/2011 Simmons ..... F16D 1/108 355/67
8,434,982 B2 * 5/2013 Henriksen, Jr. ..... F16B 37/145 411/338
9,756,930 B2 * 9/2017 Hanchett ..... A45F 5/02
2006/0010557 A1 * 1/2006 Rogers ..... A42B 1/24 2/103
2007/0006502 A1 * 1/2007 Schmelzer ..... A43B 3/0078 40/636
2008/0155788 A1 * 7/2008 Wilcox ..... A43B 3/0078 24/3.1
2008/0235917 A1 * 10/2008 Dandu Rand ..... A41F 15/02 24/90.1
2015/0089778 A1 * 4/2015 Tisol, Jr. ..... F16B 21/02 24/663
2015/0121667 A1 * 5/2015 Humpert ..... A44B 17/0041 24/687
2015/0337882 A1 * 11/2015 Iwahara ..... F16B 5/0657 24/489
2016/0007696 A1 * 1/2016 Neblett ..... A43B 3/122 24/702
2016/0316862 A1 * 11/2016 Ho ..... F16B 21/04
2016/0338455 A1 * 11/2016 Chuan ..... A44B 19/305
2017/0119108 A1 * 5/2017 Schlick ..... A44B 99/005

* cited by examiner

SYSTEM AND METHOD FOR A DETACHABLE BUTTON

CROSS REFERENCE TO RELATED APPLICATIONS

This application claims the benefit under 35 U.S.C. § 119(e) of provisional application No. 61/904,136 and U.S. patent application Ser. No. 14/540,850 filed Nov. 13, 2014 which are hereby incorporated by reference.

TECHNICAL FIELD

This invention relates generally to button fasteners on articles of clothing which may be easily attached and detached from the article.

BACKGROUND

This invention relates generally to button fasteners on articles of clothing which may be easily attached and detached from the article.

Some articles of clothing may require a significant investment of resources, for example, a blazer or jacket. Often, an owner of a blazer or jacket may enjoy wearing it with a type of button for some occasions or venues that is not desirable for other occasions or venues. For example, gold or silver buttons on the blazer might be preferred at some times, while wood or bone buttons might be preferred at other times.

It is well known that buttons are conventionally sewn to articles of clothing using thread or something similar. This type of attachment tends to be permanent, however, and at the very least, does not allow the buttons to be easily changeable. Some garment owners may lack the sewing skill needed to change conventionally sewn buttons. Even if the owner has sewing skills, the task of removing and replacing buttons is time-consuming, and repeated sewing at the site of the button may damage the fabric. An inability to change buttons as desired may thus limit the versatility and use of an article of clothing.

Thus, there is a need in the prior art for a system and method for providing a button that can easily be attached and detached from an article of clothing.

SUMMARY

According to an aspect of the invention, there is provided a detachable button system having a fixed or permanent component permanently or semi-permanently attached or fastened to a garment or other article, and at least one detachable component that is normally securely attached to the fixed component. The fixed component a disc-shaped base and a cylinder extending perpendicularly from said base, said cylinder featuring a plurality of tabs projecting perpendicularly from the cylinder and parallel to the base. The detachable portion had an interior cavity for receiving the cylinder, the interior cavity including a plurality of slots corresponding to the plurality of tabs, the slots receiving said tabs. The tabs vary across their width so as to provide a friction fit when the cylinder of the fixed component is inserted into the internal cavity of the detachable component and the detachable component is rotated.

The detachable component may have the general shape of the outer-facing part of conventional buttons, and may further include ornamentation which integral to the detachable component of incorporated a separate element. Thus, a detachable component having a first ornamental appearance, can be detached from the fixed component, and another detachable component having a different ornamental appearance, attached to the fixed component, providing the effect of changing buttons, without the need for sewing or another permanent attachment step.

DESCRIPTION OF THE DRAWINGS

Features of example implementations of the invention will become apparent from the description, the claims, and the accompanying drawings in which:

DETAILED DESCRIPTION

Figure 1:
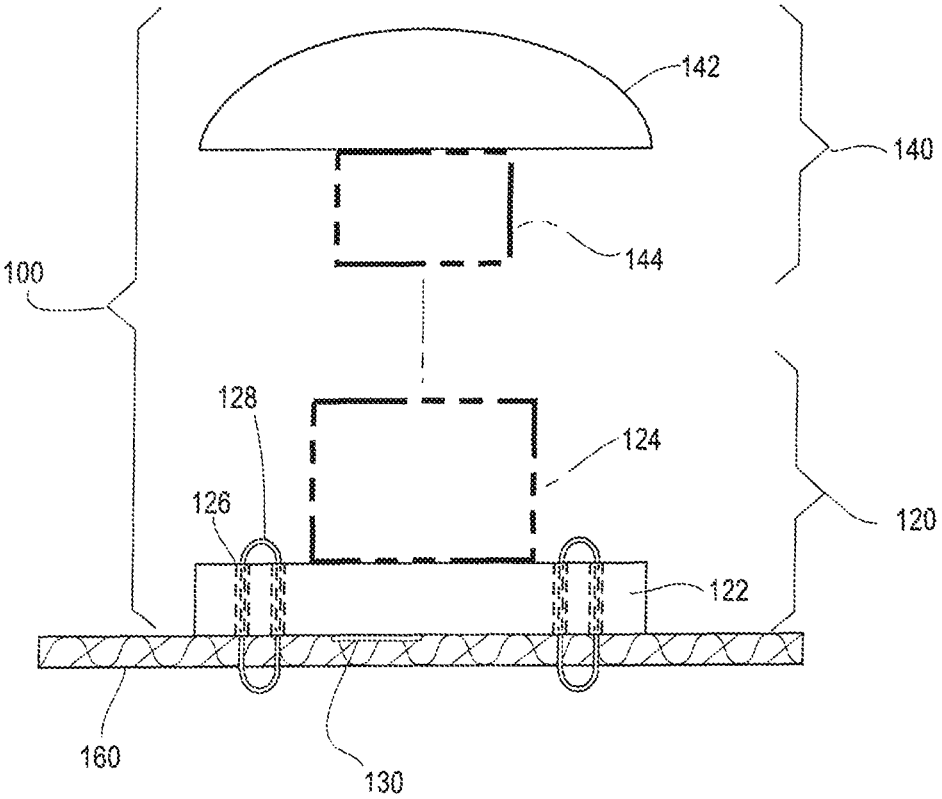
FIG. 1 depicts schematically a detachable button system 100 constructed according to an aspect of the present invention.

FIG. 1 depicts schematically a detachable button system 100 constructed according to an aspect of the present invention, according to which the detachable button system 100 has a fixed or permanent component 120 permanently or semi-permanently attached or fastened to a garment or other article 160, and at least one detachable component 140 (of which only one is shown) that is normally securely attached to the fixed component 120. The fixed component 120 and the detachable component 140 are shown in FIG. 1 in a detached configuration, but in ordinary use, these components are attached to form a button which can be employed as an ornament or can function, for example, as a closure of a garment or to secure plural layers of cloth or similar articles.

The fixed component 120 has a base element 122 and a first attachment element 124 extending therefrom. The base element 122 is permanently or semi-permanently attached or fastened to a garment or other article 160 (hereafter, "garment" is intended to refer to a garment, cloth, or other flat article with which a button may be used) by any appropriate attachment or fastening means, such as thread 128 sewn through holes or slots 126 or around appropriate tabs or shanks of the base element 122. The base element 122 could also or instead be attached or fastened to garment 160 using staples, crimped claws or other parts of the base element, or using an adhesive, glue, weld, or similar bond 130, or any other appropriate fastening.

The detachable component 140, which may be considered the "button", has an button head element 142 facing away or outward from garment 160 and a second attachment element 144 adapted to cooperate or mate with the first attachment element 124 to allow any of the detachable components 140 to be easily detached from, or attached to, the fixed component 120, without additional sewing or other permanent attachment steps.

FIG. 1 is intended as a schematic representation of the button system in which shape and relative sizes may be distorted, and detail omitted, for simplicity of explanation; details of various embodiments of the button head element 142, base element 122, and the attachment elements 124 and 144 are described further.

The detachable components 140 may have the general shape of the outer-facing part of conventional buttons, including ornamentation. Where the button system 100 is to be used as a closure, the button head element 142 preferably has a diameter larger than that of the attachment elements 124 and 144 so that the button head element 142 may interfere or capture the portion of a garment (not shown) surrounding a button hole or slot therein.

Thus, a detachable component 140 having a first ornamental appearance, can be detached from the fixed component 120, and another detachable component having a different ornamental appearance, attached to the fixed component 120, providing the effect of changing buttons, without the need for sewing or another permanent attachment step.

An embodiment 200 of a detachable button system as generally described in connection with FIG. 1, constructed according to an aspect of the present invention is shown in FIGS. 2-6.

Figure 2:
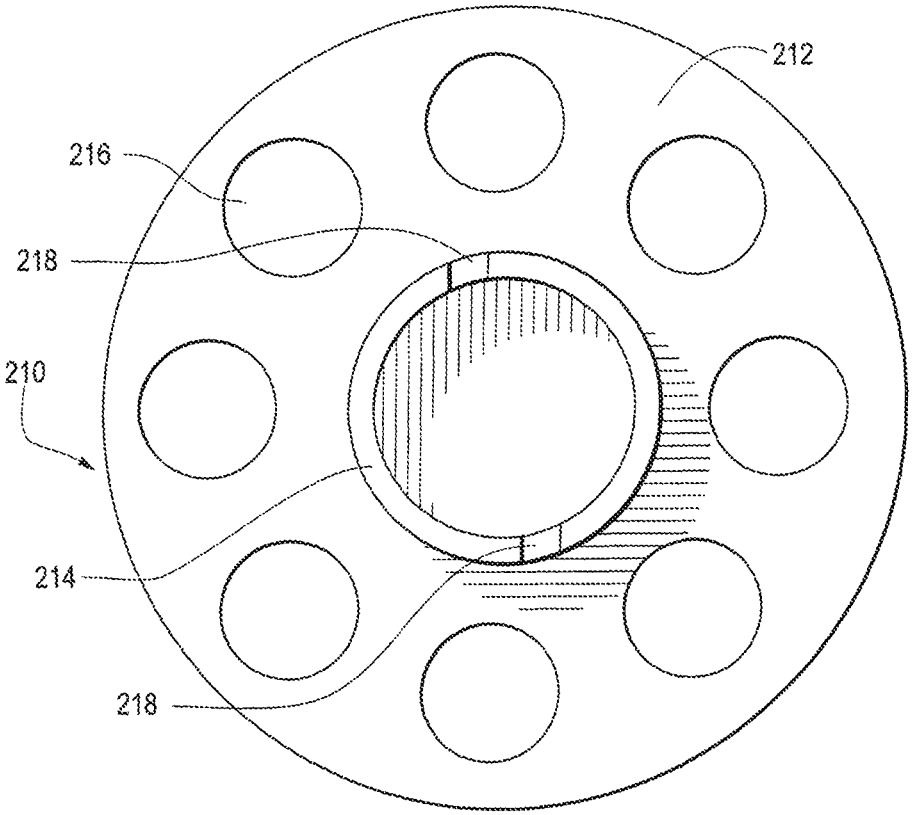
FIG. 2 is a top plan view of a fixed or permanent portion 210 of an embodiment 200 of a detachable button system constructed according to an aspect of the invention.
Figure 3:
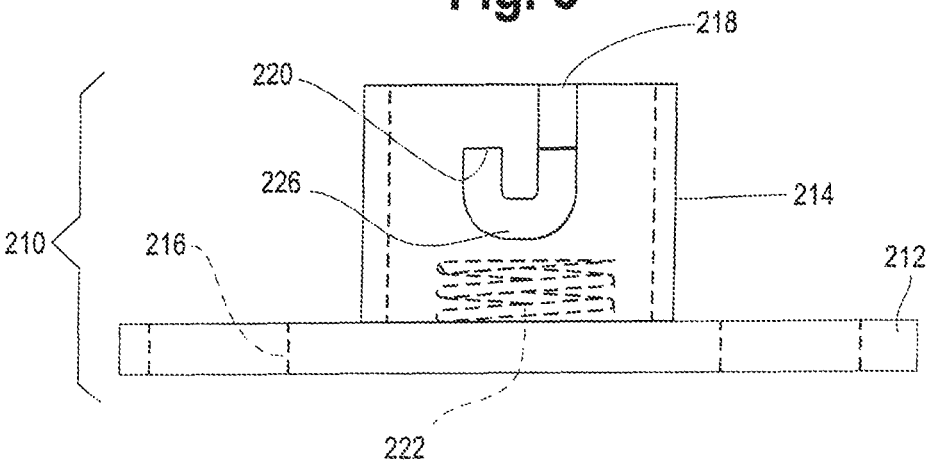
FIG. 3 is a side view of the permanent portion 210 of FIG. 2.
Figure 6:
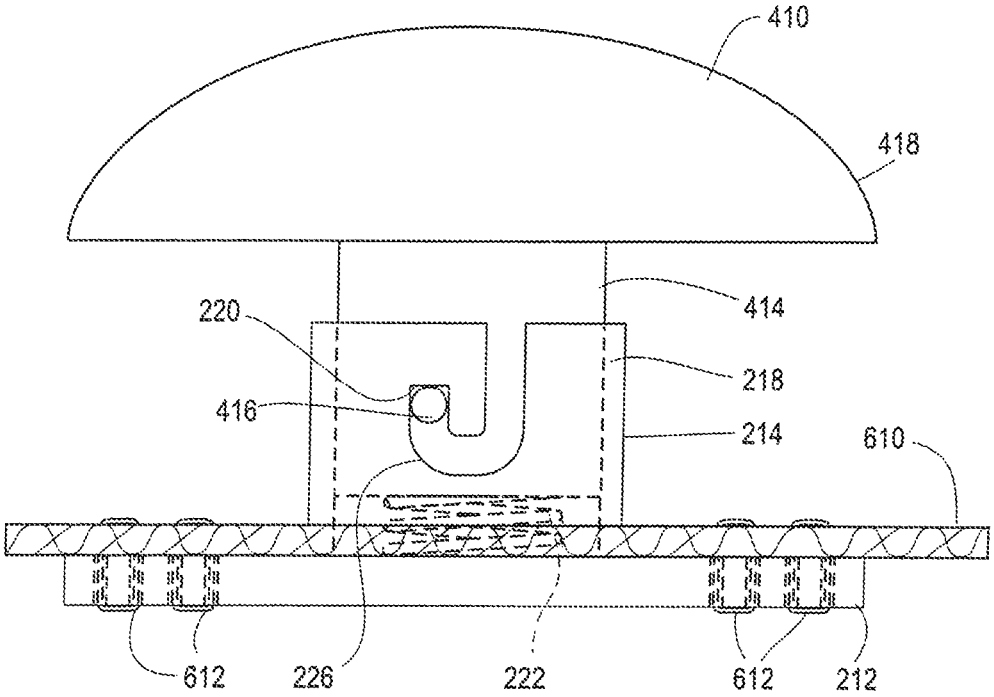
FIG. 6 is a hybrid side and cross-section view of the embodiment 200 of FIG. 2-5, showing the base plate portion 210 and the button portion 410 in the attached configuration.

The detachable button system 200 includes two portions, one 210 that is permanently attached to an article of clothing, and another 410 that may be attached and detached as desired. The permanent portion 210 is best seen in FIGS. 2-3, in which fixed component 120 of FIG. 1 is realized as a permanent portion 210; FIG. 2 is a top plan view of the permanent portion 210; FIG. 3 is a side view of the permanent portion 210; base element 122 of FIG. 1 is realized as a base plate 212; and first attachment element 124 of FIG. 1 is realized as an abutment cylinder 214;

Base plate 212 includes a number of holes 216 through which thread or similar material can pass for the purposes of attaching base plate 212 to the underside or topside of fabric or other material 610 (See FIG. 6).

Element 214 is an abutment cylinder. The abutment cylinder 214 has a set of J-shaped slots 218. One slot 218 is shown in FIG. 2 while a second slot (not shown) is disposed on the opposite side of cylinder 214. The slots are designed to receive a pin catch 416 on the detachable button portion 410 (FIGS. 4-6), described in more detail below. Element 220 indicates the stop point of slot 218. This stop point 220 holds the pin catch 416 under pressure from spring 222.

Figure 4:
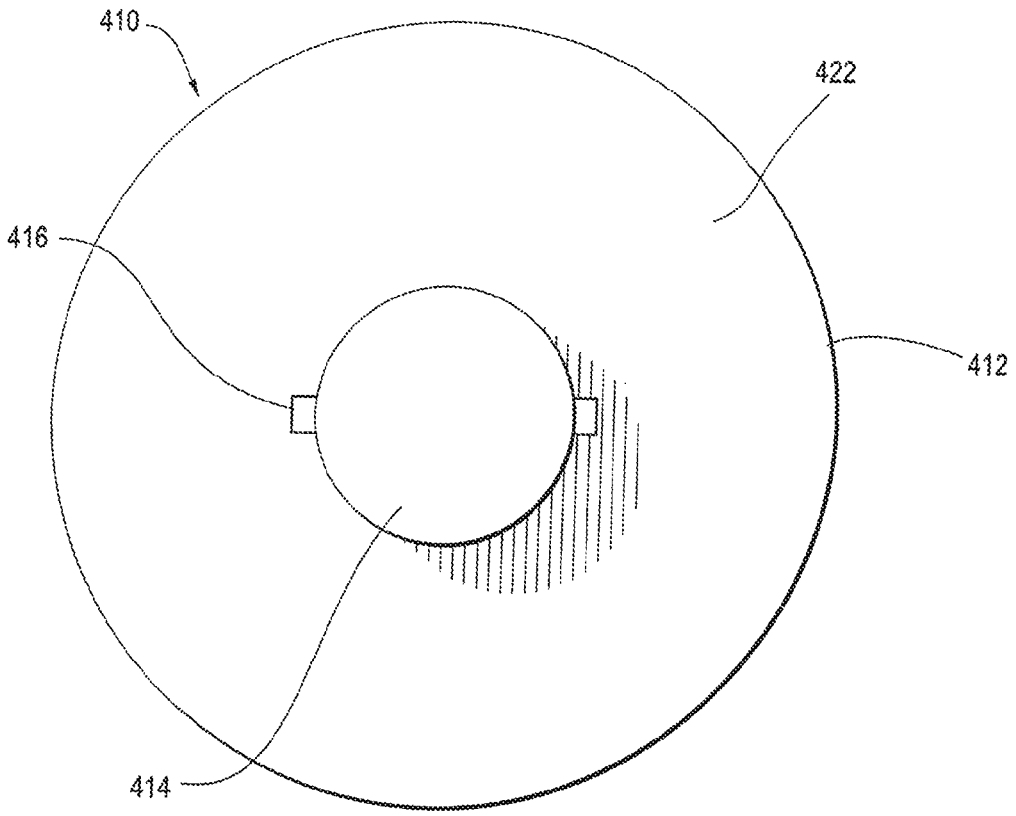
FIG. 4 is a bottom view of a detachable or button portion 410 of the embodiment 200 of FIGS. 2-3 of the detachable button system.
Figure 5:
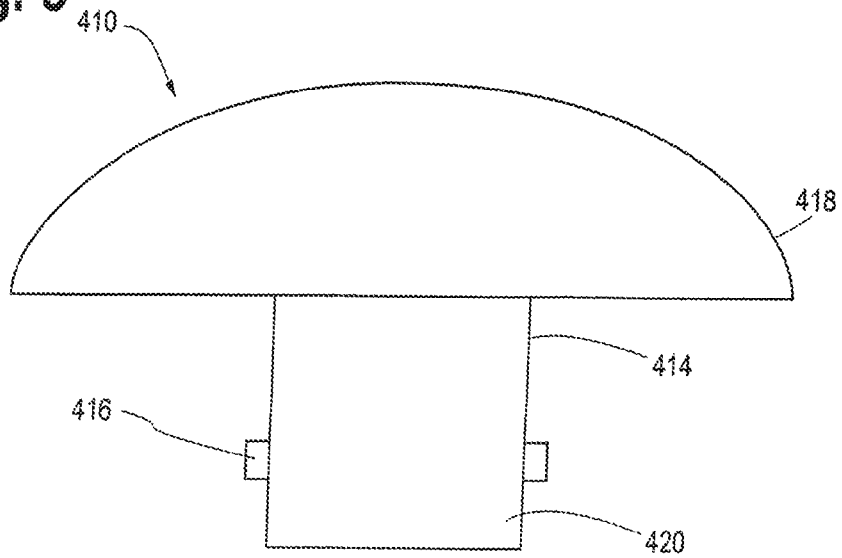
FIG. 5 is a side view of the button portion 410 of FIG. 4.

The detachable or button portion of the embodiment 200 the detachable button system is best seen in FIGS. 4-5, in which detachable component 140 of FIG. 1 is realized as a detachable portion 410; FIG. 4 is a bottom view of the detachable portion 410; FIG. 5 is a side view of the detachable portion 410; button head element 142 of FIG. 1 is realized as button head 412; and second attachment element 144 of FIG. 1 is realized as pin 414 and pin catch 416.

Button portion 410 may be used with the permanent portion 210 of FIGS. 2-3.

The underside of a button part of the detachable portion 410 is indicated at 422. Pin 414 extends perpendicularly from the underside of the button and includes a pin catch 416 on either side of pin 414. The pin catches 416 extend slightly further out from the width of abutment cylinder 214 (FIGS. 2-3, 6), thereby allowing pin 414 to be inserted into the abutment cylinder 214 only when both pin catches 416 are directly over both slots 218 of the abutment cylinder 214. As best seen in the side view, element 418 is the top of the button.

FIG. 6 is a hybrid side and cross-section view of the embodiment 200 of FIG. 2-5, showing the permanent portion 210 and the detachable button portion 410 combined in the attached configuration.

In this view, detachable button portion 410 having pin 414 is pushed downward into abutment cylinder 214. Surplus portion 420 of pin 414 extends below the slots in abutment cylinder 214, thereby compressing spring 222 and causing pin catches 416 to press against the top of stop points 220 element 15 of FIG. 1A. Then, as pin catch 416 moves through slot 218 and up towards top point 220, the spring 222 pushes back up against the pin 414, locking the pin 414 in place within the abutment cylinder 214. The action of locking the button into the abutment cylinder also requires a slight twist. To remove the button detachable button portion 410 from the permanent portion 210, the button is pushed and twisted in the opposite direction, allowing pin catches 416 to move back through slot 218 and out of abutment cylinder 214.

FIG. 6 also shows the position of base plate 212 placed against the side of material 610 that is opposite button 410. It is attached with thread 612 through the holes 216 (see FIG. 2). In an alternate embodiment, base plate 212 can be attached on the other side of material 610, in other words, on the same side as button 4. In the first case, base plate 212 is effectively attached on the inside of an article of clothing. In the alternate embodiment, it is attached on the outside of an article of clothing.

Figure 7:
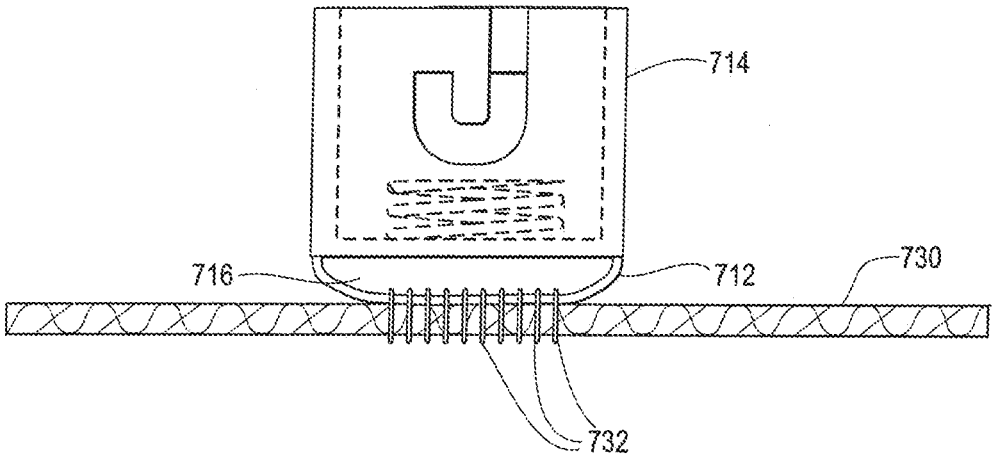
FIG. 7 is a hybrid side and cross-section view of a fixed portion 710 of another embodiment of a button system constructed according to a further aspect of the present invention.

FIG. 7 is a hybrid side and cross-section view of a fixed or permanent portion 710 of another embodiment 700 of a button system constructed according to a further aspect of the present invention. The button system embodiment 700 of FIG. 7 may generally be constructed as earlier described in connection with the embodiment 200 of FIGS. 2-6, with the fixed or permanent portion 710 modified as described below to provide an alternate way for attaching the abutment cylinder to an article of clothing. Accordingly, the embodiment 700 of FIG. 7 should be considered to inherit the characteristics and foregoing description of the embodiment 200 except as described below. As best seen in FIG. 7, abutment cylinder 714 has a shank portion 712 on the end of abutment cylinder 714 that is intended to be attached to clothing. Shank 712 is integral with abutment cylinder 714. Shank 712 is attached to clothing material 730 by means of thread 732 through opening 716 formed by the shank, or other elements in the lower portion of the shank.

Figure 8:
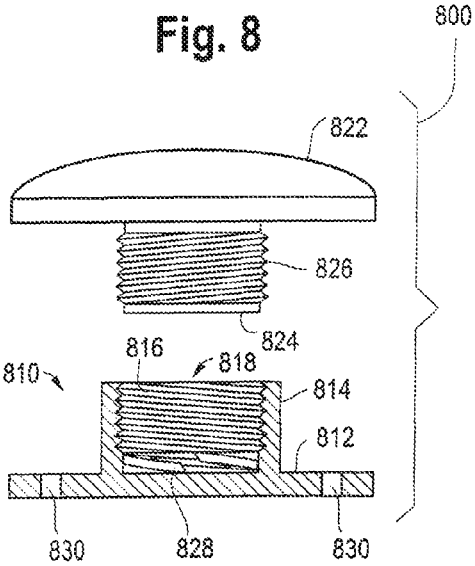
FIG. 8 is a cross-section view of another embodiment 800 of a detachable button system constructed according to a further aspect of the invention.
Figure 9:
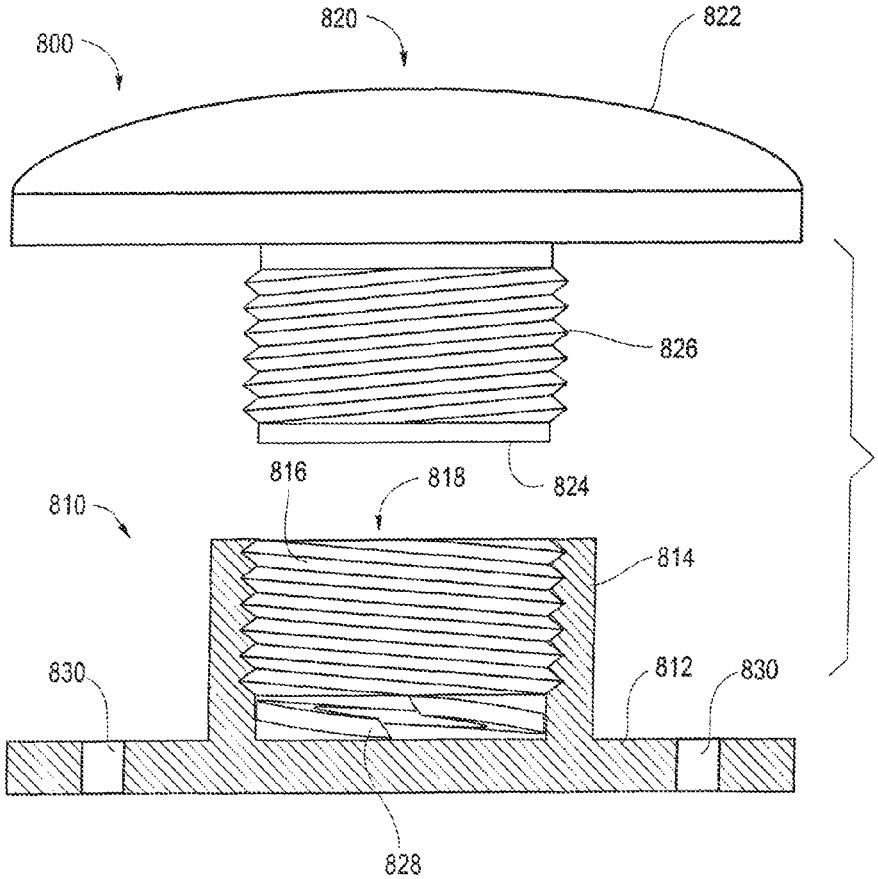
FIG. 9 is a hybrid side and cross-section view of the embodiment 800 of FIG. 8.

There is shown in FIGS. 8-9 another embodiment 800 of a detachable button system constructed according to a further aspect of the invention. The embodiment 800 may generally be constructed as earlier described in connection with the embodiment 200 of FIGS. 2-6, with the modifications hereinafter described. Accordingly, the embodiment 800 of FIGS. 8-9 should be considered to inherit the characteristics and foregoing description of the embodiment 200 except as described below.

FIG. 8 is a simplified side cross-section view of the detachable button system 800. Detachable button system 800 comprises a permanent or fixed portion 810 and a removable button portion 820. The permanent or fixed portion 810 comprises a base plate 812 equivalent to base plate 224 of FIGS. 2-3, and an abutment cylinder 814 extending from the base plate 812. The removable button portion 820 comprises a button head 822 equivalent to the button head 412 of FIGS. 4-6, and a pin 824 extending from the button head 812. The abutment cylinder 814 is hollow, as shown at 818, but threaded on the sides at 816. The pin 824 on the button 812 is correspondingly threaded at 826 so that it may be screwed into the abutment cylinder 814. At the base of the abutment cylinder 814, there is a small lock washer 828 permanently affixed to the bottom.

Figure 10:
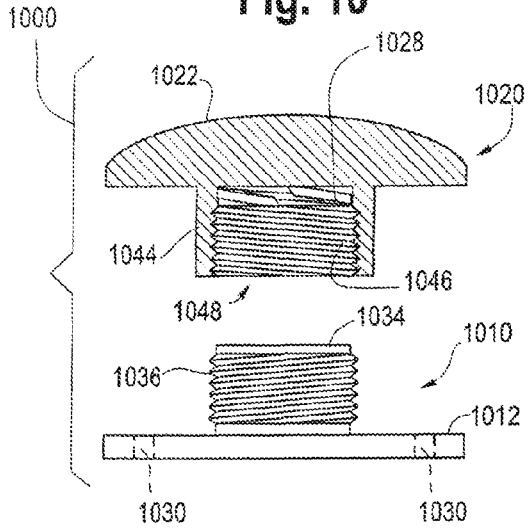
FIG. 10 is a cross-section view of another embodiment 1000 of a detachable button system constructed according to a further aspect of the invention.

There is shown in FIG. 10 another embodiment 1000 of a detachable button system constructed according to a further aspect of the invention. The embodiment 1000 may generally be constructed as earlier described in connection with the embodiment 800 of FIGS. 8-9, with the modifications hereinafter described. Accordingly, the embodiment 1000 of FIG. 10 should be considered to inherit the characteristics and foregoing description of the embodiment 800 except as described below.

FIG. 10 is a simplified side cross-section view of the detachable button system 1000. Detachable button system 1000 comprises elements similar to those of the detachable button system 800 of FIGS. 8-9 with the locations of the abutment cylinder and pin reversed. Detachable button system 1000 comprises a permanent or fixed portion 1010 and a removable button portion 1020. The permanent or fixed portion 1010 comprises a base plate 1012 equivalent to base plate 224 of FIGS. 2-3, and a pin 1034 extending from the base plate 1012. The removable button portion 1020 comprises a button head 1022 equivalent to the button head 412 of FIGS. 4-6, and an abutment cylinder 1044 extending from the button head 1022. The abutment cylinder 1044 is hollow, as shown at 1048, but threaded on the sides at 1046. The pin 1034 on the permanent portion 1010 is correspondingly threaded at 1036 so that the abutment cylinder 1044 may be screwed onto it. A small lock washer 1028 is permanently affixed near the closed end of the abutment cylinder 1048.

FIGS. 11-14 depict another embodiment 1100 of a detachable button system 1100 constructed according to a further aspect of the present invention. The button system embodiment 1100 of FIGS. 11-14 may generally be constructed as earlier described in connection with the embodiment 200 of FIGS. 2-6, modified as described below. Accordingly, the embodiment 1100 of FIGS. 11-14 should be considered to inherit the characteristics and foregoing description of the embodiment 200 except as described below.

Figure 11:
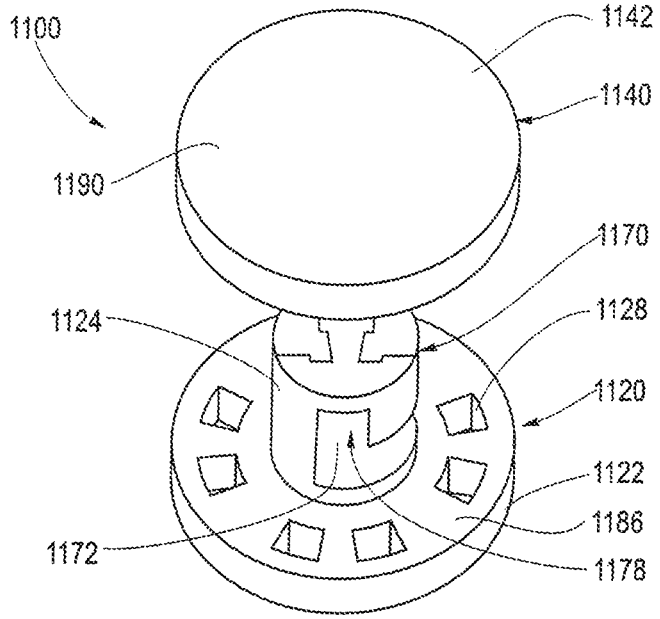
FIG. 11 is an oblique view of another embodiment 1100 of a detachable button system constructed according to a further aspect of the invention.
Figure 12:
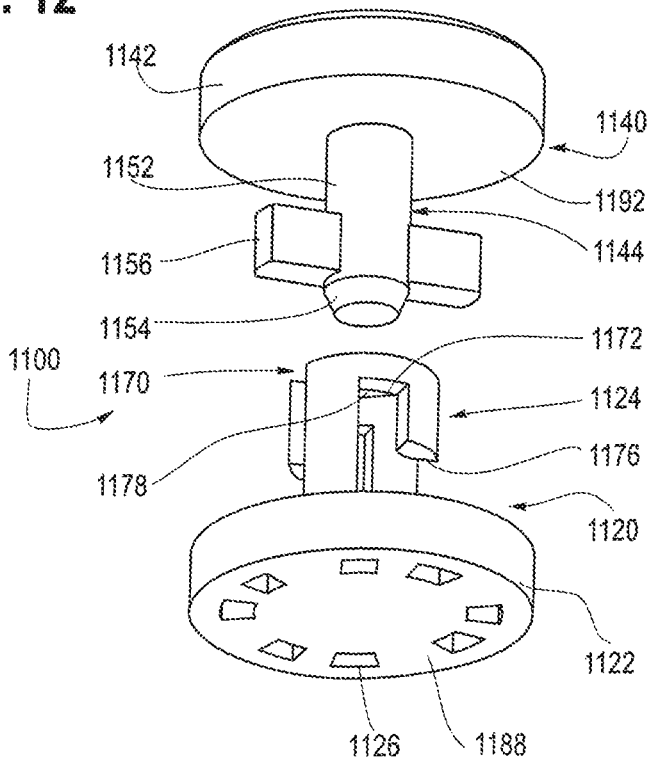
FIG. 12 is a view of the detachable button system 1100 of FIG. 11 taken from another angle.
Figure 13:
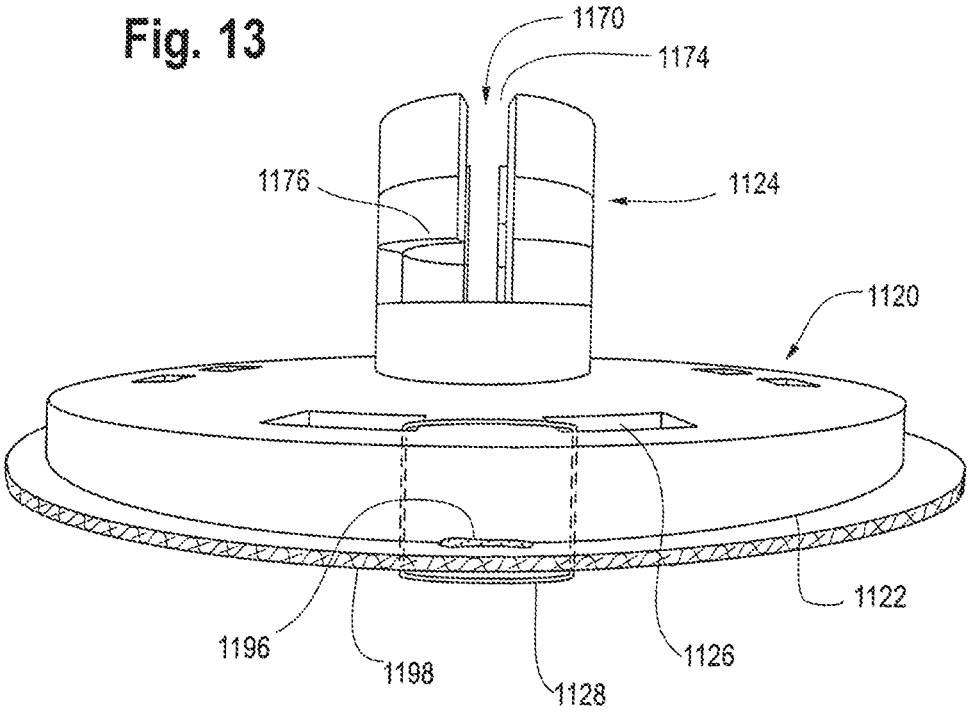
FIG. 13 is a side view of a fixed or permanent portion of the detachable button system 1100 of FIGS. 11-12.
Figure 14:
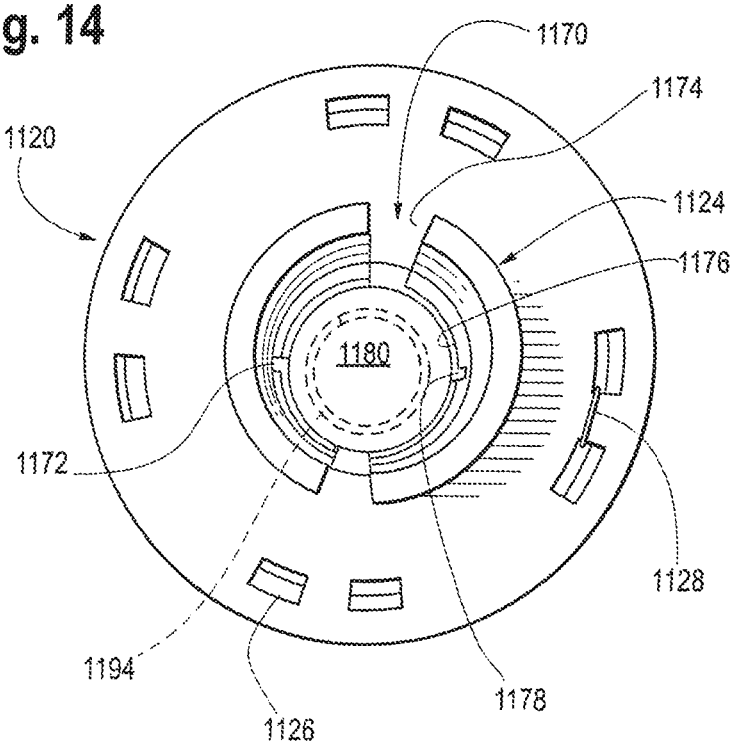
FIG. 14 is a top view of the fixed or permanent portion of the detachable button system 1100 of FIGS. 11-13.

FIG. 11 is an oblique view of the detachable button system 1100. FIG. 12 is a view of the detachable button system 1100 taken from another angle. FIG. 13 is a side view of a fixed or permanent portion 1120 of the detachable button system 1100. FIG. 14 is a top view of the fixed or permanent portion 1120 of the detachable button system 1100.

As best seen in FIG. 11, detachable button system 1100 comprises a permanent or fixed portion 1120 and a detachable button component 1140, which are adapted to be attached, coupled, or mated, in which configuration the button system 1100 may to serve as a button, which may provide a functional closure for a garment or other article, or may be solely ornamental. The permanent or fixed portion 1120 comprises a base plate 1122 and a and an abutment cylinder 1124. The detachable button component 1140 comprises a button head 1142 and an attachment pin 1144. The button head 1142 has an inner surface 1192, i.e., a surface facing toward the garment when the button system 1100 is assembled and installed, and an outer surface 1190, i.e., a surface facing away from the garment. The base plate 1122 has top surface 1186, i.e., a surface facing toward the button head 1142 when the button system 1100 is assembled, and a bottom surface 1188, facing away from the button head. The attachment pin 1144 is attached to or integrally formed with the button head 1142 at the inner surface 1192 and generally extends away therefrom. The abutment cylinder 1124 is attached to or integrally formed with the base plate 1122 at the top surface 1186 and generally extends away therefrom.

Comparing the features of the detachable button system 100 of FIG. 1 described more generally above, to those of button system 1100 of FIGS. 11-16, the fixed component 120 of FIG. 1 is realized as permanent or fixed portion 1120; base element 122 of FIG. 1 is realized as permanent or fixed portion 1120; and the first attachment element 124 of FIG. 1 is realized as abutment cylinder 1124. Likewise, the detachable component 140 of FIG. 1 is realized as detachable button component 1140; the button head element 142 of FIG. 1 is realized as button head 1142; and the second attachment element 144 of FIG. 1 is realized as pin 1144.

The base plate 1122 is preferably attached to a garment or other article 1198 (FIG. 13) using any appropriate attachment or fastening means. The base plate 1122 may be formed as a generally-disc-shaped member. The base plate 1122 may have apertures 1126 or other structures such as legs, stakes, or crimpable claws (not shown) to accommodate attachment or fastening of the base plate 1122 to garment 1198 on a permanent or semi-permanent basis. For example, base plate 1122 may be sewn to the garment or other article 1198 using thread, wire, or another filament material, shown schematically as item 1128 (FIGS. 12-13). Base plate 1122 could also be stapled to the garment or other article 1198. If legs, stakes, or crimpable claws are provided, such components may be mechanically shaped or formed at the time of installation to provide a secure attachment. The base plate 1122 could also be attached to garment or article 1198 using an adhesive, cement, or by welding, as represented by item 1196 (FIG. 13). Although base plate 1122 is shown and described as disc-shaped, other shapes could also be used, including oval, square, or triangular, or the like. The diameter of the base plate is preferably large enough to allow forces associated with the use of the button to be distributed over a large enough area of the garment or article 1198 to avoid damage over the lifetime of the garment.

Attachment pin 1144 of the detachable button component 1140 comprises a trunk or body portion 1152 having an end at 1154. The abutment cylinder 1124 of the permanent or fixed portion 1120 forms an opening 1180 (FIG. 14) to receive the mating attachment pin 1144 of detachable button component 1140. The end 1154 of pin 1144 may be narrowed to facilitate insertion of the end into the abutment cylinder opening 1180. Pin 1144 has at least one structural feature adapted to cooperate with a feature of abutment cylinder 1124 to detachably retain the pin 1144 in a coupled or mated relationship with the abutment cylinder 1124, and therefore to detachably retain the detachable button component 1140 and the permanent or fixed portion 1120 in a coupled or assembled relationship. As best seen in FIG. 12, pin 1144 comprises a pair of pin catch arms 1156 extending radially from the body portion 1152 near the end 1154 thereof. As best seen in FIGS. 13-11-14, the abutment cylinder 1124 comprises a pair of slots 1170 for receiving and retaining the pin catch arms 1156. The slots may, for example, be shaped to help retain the pin catch arms 1156 in an "assembled" position. For example, each of slots 1170 may have a modified "J" shape extending longitudinally from an opening 1174 at the top of the abutment cylinder 1124 toward the base plate 1122; then extending circumferentially for a short extent; and then extending longitudinally away from the base plate, ending at a stop location 1172. A spring 1194 is provided in the interior of the abutment cylinder to bear upward against the end 1154 of pin 1144.

In operation, when the detachable button component 1140 is installed on the permanent or fixed portion 1120, the pin catch arms 1156 are received in the pin capture slots 1170 and travel longitudinally therealong, until the arms 1156 reach the bottom of the "J" shaped slots. The detachable button component 1140 is rotated or twisted to cause the arms 1156 to travel along slots at the base of the "J" to reach the truncated longitudinal sections thereof, and then allowed to travel longitudinally upward therealong, away from the base plate 1122, to rest at the stop locations 1172. Pressure from the spring 1194 keeps the arms 1156 at the stop locations 1172, and the shape of the material of abutment cylinder 1124 forms an interfering ridge that prevents the arms from rotating away from the stop locations 1172 absent pressure to overcome the spring 1194.

In order to release or detach the detachable button component 1140, the user may depress the button to overcome pressure from the spring 1194 to push the pin catch arms 1156 to the base of the "J"-shaped slots, and then rotate the arms 1156 to reach the open portions of slots 1170, whereby the detachable button component 1140 may be released.

Spring 1194 may be realized using any appropriate spring or other resilient component, such as a coil spring, leaf spring, resilient foam, or other resilient material. Spring 1194 could also be a torsion spring; the end 1154 of pin 1144 could be modified to engage spring 1194 such that it resists the rotation of the pin catch arms 1156 necessary to release the arms from the abutment cylinder pin capture slots 1170.

Although embodiment 1100 is described herein as comprising two abutment cylinder pin capture slots 1170 and two pin catch arms 1156, some other number of slots and arms could also be used. Other shapes could also be used for the pin capture slots 1170, and arms 1156 and slots 1170 could be modified in complementary ways so that the detachable button component 1140 may accept and detachably retain the permanent or fixed portion 1120 in an assembled configuration.

Figure 15:
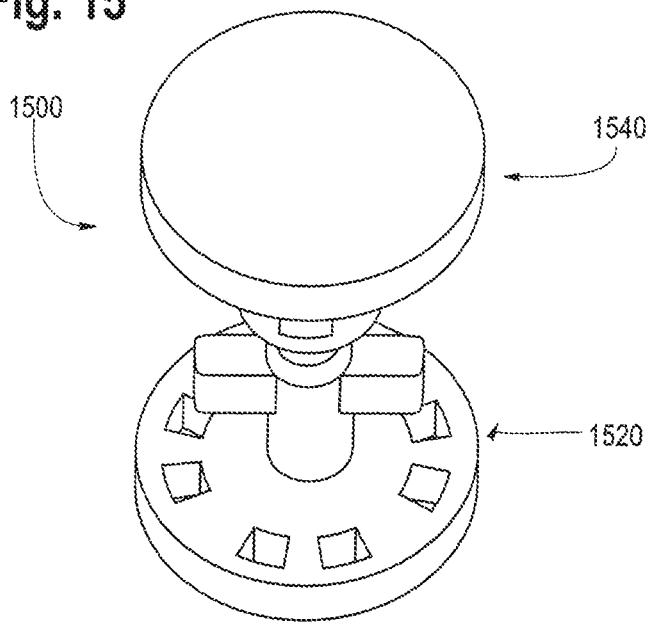
FIG. 15 is an oblique view of another embodiment 1500 of a detachable button system constructed according to a further aspect of the invention.
Figure 16:
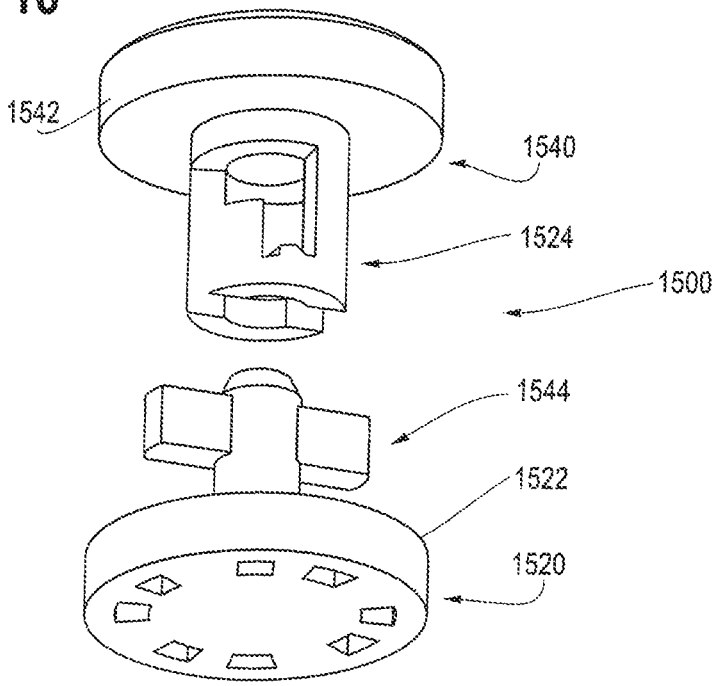
FIG. 16 is a view of the detachable button system 1500 of FIG. 15 taken from another angle.

There is shown in FIGS. 15-16 another embodiment 1500 of a detachable button system constructed according to a further aspect of the invention. The embodiment 1500 may generally be constructed as earlier described in connection with the embodiment 1100 of FIGS. 11-14 with the modifications hereinafter described. Accordingly, the embodiment 1500 of FIGS. 15-16 should be considered to inherit the characteristics and foregoing description of the embodiment 1100 except as described below.

FIG. 15 is an oblique view of the detachable button system 1500. FIG. 16 is a view of the detachable button system 1500 taken from another angle. Detachable button system 1500 comprises elements similar to those of the detachable button system 1100 of FIGS. 11-14 with the locations of the abutment cylinder and pin reversed. Detachable button system 1500 comprises a permanent or fixed portion 1520 and a removable button portion 1540. The permanent or fixed portion 1520 comprises a base plate 1522 equivalent to the base plate 1122 of FIGS. 11-14, and a pin 1544 extending from the base plate 1522. The removable button portion 1540 comprises a button head 1542 equivalent to the button head 1542 of FIGS. 11-12, and an abutment cylinder 1524 extending from the button head 1542. The abutment cylinder 1524 and the pin 1544 cooperate in a manner similar to the equivalent components of the button system 1100 of FIGS. 11-14 to allow the permanent or fixed portion 1520 and removable button portion 1540 to form an assembled detachable button system.

Figure 17:
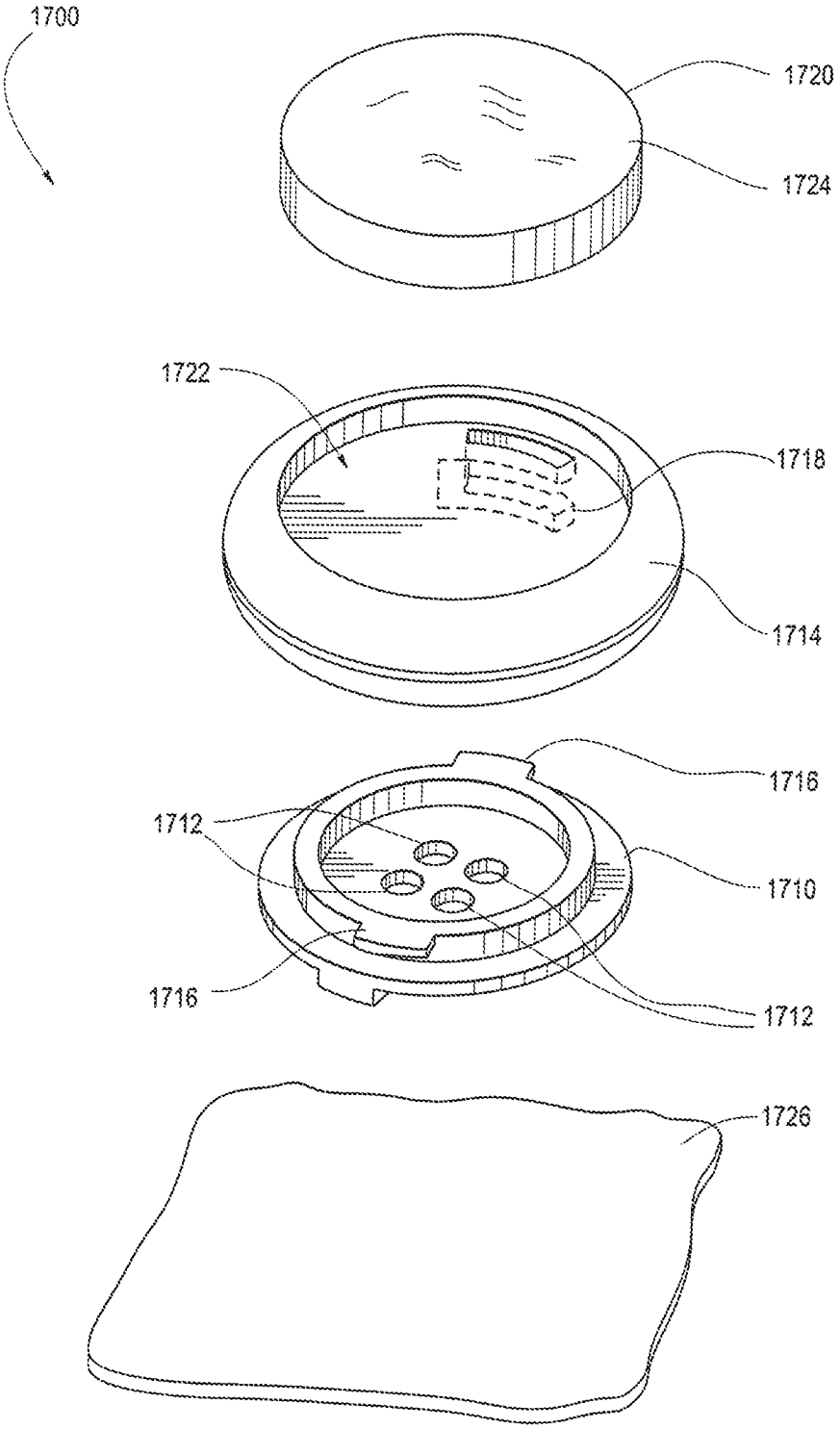
FIG. 17 is an oblique expanded view of another embodiment 1700 of a detachable button system constructed according to a further aspect of the invention.

There is shown in FIGS. 17-23 another embodiment 1700 of a detachable button system constructed according to a further aspect of the invention. FIG. 17 is an oblique expanded view of detachable button system 1700. Similarly to the other embodiments, detachable button system 1700 includes a bottom 1710 that may be attached by means of holes 1712 to an article of clothing, represented as swatch 1726. A top removable portion 1714 is attached to bottom 1710 by means of tabs 1716 on bottom 1710 that are seated into slots 1718 in top 1714 as will be discussed below. Top 1714 is sized so that is will cover bottom 1710 when attached. In an embodiment, bottom 1710 is made of plastic or other inexpensive and easily available material. Top 1714 may be made from plastic or any other decorative material as desired, for example, metal, resin, wood, or bone. An optional decorative disk may be inserted into recessed area 1722 on top 1714. Disk 1720 made of the same or a different material as that of top 1714. In a further embodiment, disk 1720 may have a design or pattern on outward facing surface 1724 to provide further decorative options.

Figure 18:
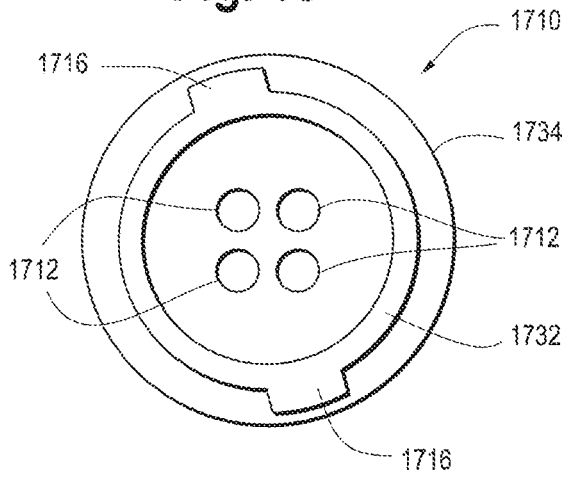
FIG. 18 is a top view of a bottom portion of the button system of FIG. 17.
Figure 19:
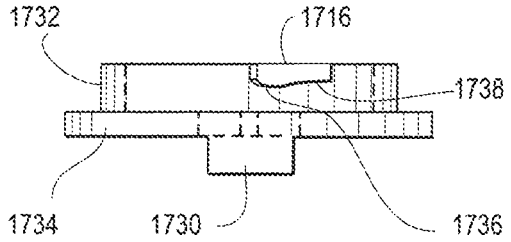
FIG. 19 is a side view of a bottom portion of the button system of FIG. 17.
Figure 20:
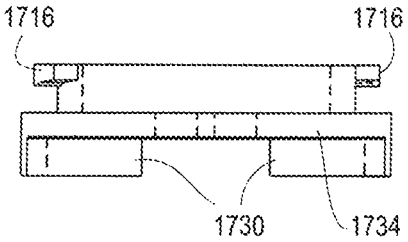
FIG. 20 is another side view of a bottom portion of the button system of FIG. 17.
Figure 21:
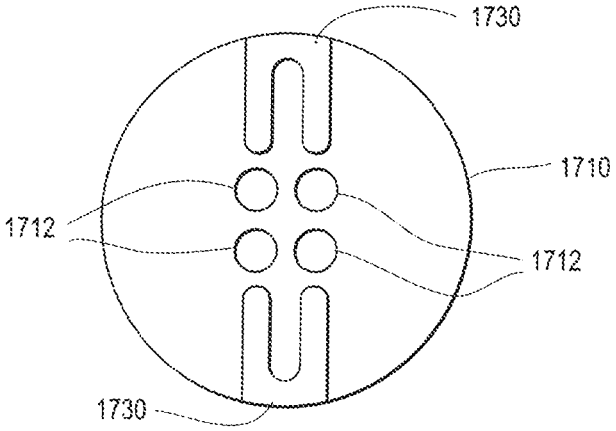
FIG. 21 is a bottom view of a bottom portion of the button system of FIG. 17.

FIGS. 18-21 show various views of button system bottom 1710. FIG. 18 is a top view, FIG. 19 is a side view, FIG. 20 is another side view rotated by 90 degrees from FIG. 18 while FIG. 21 is a bottom view. Elements in common with FIG. 17 have the same numbering. Bottom 1710 includes a base 1734 and a cylinder 1732. Tabs 1716 are located on either side of cylinder 1732 and extend perpendicularly away from the walls of cylinder 1732. A lower portion of each tab 1716 is curved so that tab 1716 has a thicker portion 1736 and a thinner portion 1738 across its width. Projections 1730 on the lower surface of base 1734 assist is installing and removing top 1714 as described below. Although two tabs are shown, in another embodiment 3 or more tabs could be attached to cylinder 1732, with a corresponding number of slots 1718 in top 1714.

Figure 22:
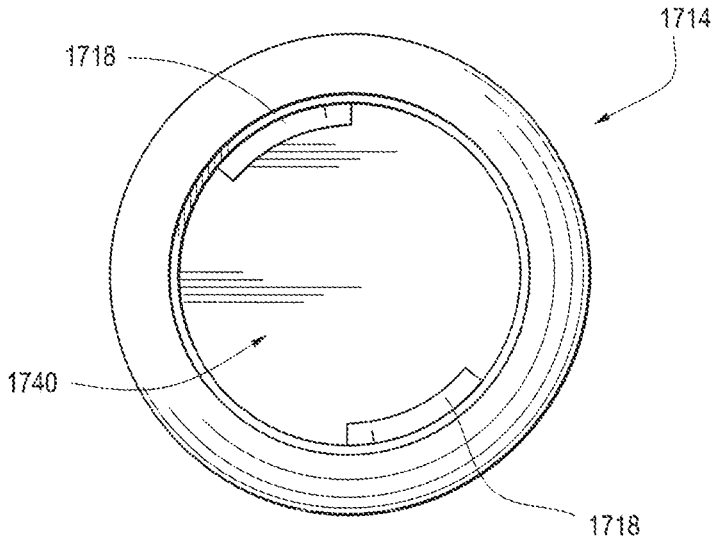
FIG. 22 is a bottom view of a top portion of the button system of FIG. 17.

FIG. 22 is a bottom view of button system top 1714 of FIG. 17. An interior cavity 1740 receives cylinder 1732. Slots 1718 engage with tabs 1716 of FIG. 17. Slots 1718 have an aperture dimension between the two prongs of the slot that receives the thickness dimension of tabs 1716. The width of slots 1718 is approximately equivalent to the width of tabs 1716 as explained below.

Figure 23:
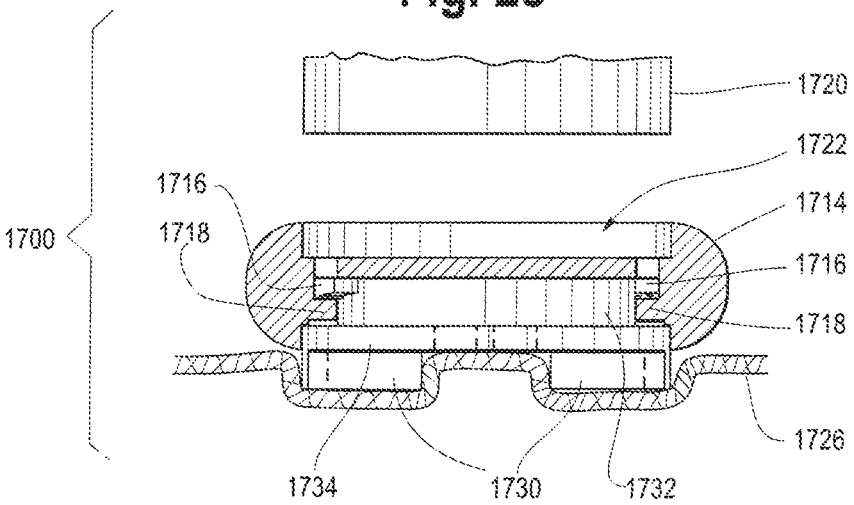
FIG. 23 is an expanded cross sectional view of the button system of FIG. 17.

FIG. 23 is an expanded cross sectional view of button system 1700 of FIG. 17. Button top 1714 is installed on button bottom 1710 using a twisting motion. Thinner portion 1738 of each tab 1716 (FIG. 19) enters a corresponding slot 1718. With a further twisting motion, thicker portion 1736 enters slot 1718 and provides a friction fit to secure top 1714 to bottom 1710. In an embodiment, the thinner portion 1738 of each tab has a dimension slightly smaller than that of the aperture of slot 1718 while thicker portion 1736 has a dimension approximately the same as the aperture dimension. To remove top 1714, a reverse twisting motion is used to remove tabs 1716 from slots 1718 so that top 1714 may be lifted away from bottom 1710 which has been secured to clothing 1726. In an embodiment, the diameter of cylinder 1732 is approximately 80-90% of the diameter of base 1734. In a further embodiment, top 1714 encloses and completely covers bottom 1710.

Embodiments of the detachable button systems disclosed herein could be constructed of any appropriate materials, including metals, plastics, resins, wood, bone, and the like. Components may be manufactured using any appropriate manufacturing methods, including stamping, molding, machining, 3-D printing, and the like.

Each of the embodiments of detachable button systems disclosed herein provide user-operable attachment and detachment of a button component from a component fixed or permanently attached to a garment or article. The button component can be attached or detached without damaging the fixed or permanent component and without damaging the garment or article. Moreover, the button component can be detached and replaced with a different button component to vary the appearance or function of the garment or article.

The drawings herein are intended to depict the general arrangement and operation of components. Modifications to the shapes and relative sizes may be appropriate for commercial embodiments, and in particular, it may be desirable to reduce the relative dimension of commercial embodiments along the longitudinal axes thereof, or in the direction normal to the plane of the garments or articles with which the detachable button systems are used.

Although example implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A detachable button system comprising:

a first portion adapted for permanent attachment to an article of clothing, said first portion having a disc-shaped base and a cylinder extending perpendicularly from said base, said cylinder further comprising a plurality of tabs projecting perpendicularly from the cylinder and parallel to the base;

a second button-shaped portion, said second portion having an interior cavity for receiving the cylinder, said interior cavity further comprising a plurality of slots corresponding to the plurality of tabs, said slots receiving said tabs;

wherein said tabs have a width dimension, said tabs further comprising a thicker portion and a thinner portion across their width which are oriented such that the thinner portion enters its corresponding slot first when the cylinder of the first portion is inserted into the internal cavity of the second portion and the second portion is rotated;

wherein the thicker portion of each tab has a dimension approximately equal to the width of its corresponding slot to provide a friction fit that retains the second button-shaped portion in attachment with the first portion; and wherein said base has a first diameter and said cylinder has a second diameter that is approximately 80-90% of the first diameter.

2. The detachable button system of claim 1, wherein said second button-shaped portion further comprises a recessed area opposite the cavity for receiving a disk.

3. The detachable button system of claim 2, wherein the disk further comprises a decorative design.

4. The detachable button system of claim 1, wherein the first portion is made from a plastic material.

5. The detachable button system of claim 1 wherein the second portion is made from at least one of metal, wood, bone or plastic.

6. The detachable button system of claim 1, wherein the internal cavity completely encloses the first portion.

7. The detachable button system of claim 1 wherein said base of said first portion has a plurality of apertures and said base is adapted for attachment to an article of clothing by sewing through said apertures.

* * * * *